US008940366B2

(12) United States Patent
Cameron et al.

(10) Patent No.: US 8,940,366 B2
(45) Date of Patent: Jan. 27, 2015

(54) APPARATUS AND METHOD FOR TREATING MATERIALS WITH COMPOSITIONS

(75) Inventors: John Christopher Cameron, Acworth, GA (US); Edwin A. Neal, Edwards, CO (US)

(73) Assignee: Petra International Holdings, LLC, Crestview, FL (US)

( * ) Notice: Subject to any disclaimer, the term of this patent is extended or adjusted under 35 U.S.C. 154(b) by 489 days.

(21) Appl. No.: 12/484,377

(22) Filed: Jun. 15, 2009

(65) Prior Publication Data

US 2009/0252873 A1 Oct. 8, 2009

Related U.S. Application Data

(62) Division of application No. 11/801,139, filed on May 9, 2007.

(51) Int. Cl.

| | |
|---|---|
| ***C23C 16/00*** | (2006.01) |
| ***D21H 19/32*** | (2006.01) |
| *D21H 19/08* | (2006.01) |
| *D21H 19/14* | (2006.01) |

(52) U.S. Cl.

CPC ..... *D21H 19/32* (2013.01); *D21H 19/08* (2013.01); *D21H 19/14* (2013.01)

USPC ..... 427/248.1; 427/421.1; 427/331; 427/372.2

(58) Field of Classification Search

USPC ..... 427/421.1, 248.1, 331, 372.2

See application file for complete search history.

(56) References Cited

U.S. PATENT DOCUMENTS

| | | | | |
|---|---|---|---|---|
| 2,306,222 | A | 12/1942 | Patnode | |
| 2,386,259 | A | 10/1945 | Norton | |
| 2,412,470 | A | 12/1946 | Norton | |
| 2,615,824 | A | 10/1952 | Minor et al. | |
| 2,647,136 | A | 7/1953 | Sauer | |
| 2,782,090 | A | 2/1957 | Robbart | |
| 2,802,850 | A | 8/1957 | Wetzel | |
| 2,824,778 | A | 2/1958 | Robbart | |
| 2,961,338 | A | 11/1960 | Robbart | |
| 2,995,470 | A | 8/1961 | Robbart | |
| 3,418,312 | A | 12/1968 | Klebe | |
| 3,607,901 | A | 9/1971 | Berger | 260/448.2 N |
| 3,637,570 | A | 1/1972 | Stout | |

(Continued)

FOREIGN PATENT DOCUMENTS

| | | |
|---|---|---|
| CA | 2236893 | 5/1998 |
| DE | 1277192 | 9/1968 |

(Continued)

OTHER PUBLICATIONS

Interaction of Silane Coupling Agents with Cellulose by Mekki Abdelmouleh et al., American Chemical Society, Mar. 19, 2002, pp. 3203-3208.

(Continued)

*Primary Examiner* — Nathan T Leong

(74) *Attorney, Agent, or Firm* — Greenberg Traurig, LLP

(57) ABSTRACT

An apparatus and method for treating subject materials with compositions includes a material treatment section for treating a subject material with a composition of a silane-containing material and a hydrocarbon solvent to form a treated material, and a neutralizing section for neutralizing the treated material such that the treated material has a pH in a range of approximately 7 to approximately 8.

19 Claims, 1 Drawing Sheet

(56) References Cited

U.S. PATENT DOCUMENTS

| | | | | |
|---|---|---|---|---|
| 3,682,675 | A | 8/1972 | Myers | |
| 3,806,549 | A | 4/1974 | Foley | |
| 3,856,558 | A | 12/1974 | Robbart | |
| 3,986,999 | A | 10/1976 | Sattlegger et al. | |
| 4,002,800 | A | 1/1977 | Nestler et al. | |
| 4,013,474 | A | 3/1977 | Teitell et al. | |
| 4,109,032 | A | 8/1978 | Barrall | |
| 4,151,327 | A | 4/1979 | Lawton | |
| 4,170,690 | A | 10/1979 | Armbruster et al. | |
| 4,339,479 | A | 7/1982 | Robbart | |
| 4,349,610 | A | 9/1982 | Parker | |
| 4,386,134 | A | 5/1983 | Puhringer | |
| 4,423,112 | A | 12/1983 | Luthringshauser et al. | |
| 4,491,669 | A | 1/1985 | Arkles et al. | |
| 4,498,538 | A | 2/1985 | Watkins et al. | 166/295 |
| 4,534,815 | A | 8/1985 | Hamada et al. | |
| 4,544,413 | A | 10/1985 | Boots et al. | |
| 4,551,385 | A * | 11/1985 | Robbart | 428/323 |
| 4,554,215 | A | 11/1985 | Robbart | |
| 4,567,221 | A | 1/1986 | Maruyama et al. | |
| 4,678,688 | A | 7/1987 | Itoh et al. | |
| 4,735,830 | A | 4/1988 | Oezelli et al. | |
| 4,835,014 | A | 5/1989 | Roth et al. | |
| 4,851,558 | A | 7/1989 | Nishida et al. | |
| 4,859,359 | A | 8/1989 | DeMatteo et al. | |
| 5,073,195 | A | 12/1991 | Cuthbert et al. | |
| 5,120,581 | A | 6/1992 | Brunken et al. | |
| 5,204,186 | A | 4/1993 | Brunken et al. | |
| 5,294,252 | A | 3/1994 | Gun | |
| 5,374,761 | A | 12/1994 | Bank | 556/471 |
| 5,407,709 | A | 4/1995 | Ogawa et al. | |
| 5,413,808 | A | 5/1995 | Wyner | |
| 5,565,592 | A | 10/1996 | Patsidis et al. | |
| 5,652,026 | A | 7/1997 | Saka et al. | |
| 5,689,754 | A | 11/1997 | Yoshida et al. | |
| 5,871,817 | A | 2/1999 | Nasheri | |
| 5,990,043 | A | 11/1999 | Kugler et al. | |
| 6,440,277 | B1 | 8/2002 | D'Amato | |
| 6,485,785 | B1 | 11/2002 | Mino et al. | |
| 6,663,979 | B2 | 12/2003 | Deodhar et al. | |
| 6,676,733 | B2 | 1/2004 | Ludwig et al. | 106/2 |
| 6,740,357 | B2 * | 5/2004 | Yamaguchi et al. | 427/352 |
| 6,902,767 | B2 | 6/2005 | Kelsoe | |
| 7,022,291 | B1 * | 4/2006 | Beholz | 422/129 |
| 7,128,778 | B2 | 10/2006 | Thompson | |
| 7,192,470 | B2 | 3/2007 | Neal et al. | |
| 7,205,422 | B2 | 4/2007 | Norman | |
| 7,267,714 | B2 | 9/2007 | Thompson | |
| 7,300,502 | B2 | 11/2007 | Thompson | |
| 7,425,367 | B2 | 9/2008 | O'Rear, III et al. | |
| 7,432,387 | B2 | 10/2008 | Komuro et al. | |
| 7,463,572 | B2 | 12/2008 | Frommer et al. | |
| 7,754,288 | B2 | 7/2010 | Neal et al. | |
| 7,758,924 | B2 | 7/2010 | Thompson | |
| 2002/0048679 | A1 | 4/2002 | Lohmer et al. | |
| 2002/0110644 | A1 | 8/2002 | Kelsoe | |
| 2003/0059545 | A1 | 3/2003 | Kelsoe | |
| 2003/0087035 | A1 | 5/2003 | Kelsoe | |
| 2003/0157256 | A1 | 8/2003 | Yamaguchi et al. | |
| 2004/0020430 | A1 | 2/2004 | Ignatiev et al. | |
| 2005/0153152 | A1 | 7/2005 | Kelsoe | |
| 2005/0186348 | A1 * | 8/2005 | Kelsoe | 427/372.2 |
| 2005/0271821 | A1 * | 12/2005 | Lee et al. | 427/355 |
| 2006/0008840 | A1 | 1/2006 | Goldberg et al. | |
| 2006/0088605 | A1 * | 4/2006 | Neal et al. | 424/658 |
| 2006/0240346 | A1 | 10/2006 | Toda et al. | |
| 2006/0284951 | A1 | 12/2006 | Ikeda et al. | |
| 2007/0107630 | A1 | 5/2007 | Neal et al. | |
| 2007/0275257 | A1 | 11/2007 | Muraguchi et al. | |
| 2008/0014110 | A1 | 1/2008 | Thompson | |
| 2008/0047460 | A1 | 2/2008 | Neal et al. | |
| 2008/0047467 | A1 | 2/2008 | Thompson | |
| 2008/0075874 | A1 | 3/2008 | Kelsoe | |
| 2008/0124549 | A1 | 5/2008 | Lee et al. | |
| 2008/0276970 | A1 | 11/2008 | Cameron et al. | |

FOREIGN PATENT DOCUMENTS

| | | | |
|---|---|---|---|
| DE | 262019 | | 11/1988 |
| DE | 3900303 | | 7/1990 |
| EP | 0339957 | | 3/1994 |
| EP | 0747184 | | 12/1997 |
| EP | 1080794 | A2 | 3/2001 |
| EP | 1840113 | A | 10/2007 |
| JP | 5638366 | | 4/1981 |
| JP | 5719736 | A | 2/1982 |
| JP | 57036168 | | 2/1982 |
| JP | 01305006 | | 12/1989 |
| JP | 026488 | | 1/1990 |
| JP | 0543838 | | 2/1993 |
| JP | 08318509 | | 12/1996 |
| JP | 09087115 | | 3/1997 |
| JP | 09300312 | | 11/1997 |
| JP | 1025199 | | 9/1998 |
| JP | 1 192694 | | 4/1999 |
| JP | 200008354 | | 3/2000 |
| JP | 2003-193370 | | 7/2003 |
| PL | 148704 | | 3/1990 |
| SE | 502117 | | 8/1995 |
| SU | 310891 | | 3/1970 |
| WO | WO85/02205 | | 5/1985 |
| WO | WO9702119 | | 1/1997 |
| WO | WO0193685 | | 12/2001 |
| WO | WO0197985 | | 12/2001 |
| WO | WO 03/068781 | A1 | 8/2003 |
| WO | WO2005/019321 | | 3/2005 |
| WO | 2006068118 | A1 | 6/2006 |
| WO | WO2006/068118 | | 6/2006 |
| WO | 2006/078625 | A1 | 7/2006 |
| WO | 2007036906 | A2 | 4/2007 |
| WO | WO2007/036906 | | 4/2007 |

OTHER PUBLICATIONS

Japanese Abstract for JP57-019736 downloaded on Jun. 25, 2010, 1 page.

Derwent-Acc-No. 2008-M13361, Abstract of Chinese Patent Specification No. CN101104763A (Jan. 2008), 3 pages.

English language abstract for WO2006/068118 extracted from espacenet on Jun. 17, 2010, 1 page.

English language abstract and machine-assisted English translation for WO 03/068781 extracted from the espacenet.com database on Nov. 20, 2013, 24 pages.

Cordt Zollfrank, "Silylation of Solid Beech Wood", Wood Science and Technology, vol. 35, Jan. 1, 2001, pp. 183-189.

Barton et al., "Dimethylsilanone (Me2Si:0) generation by retroene decomposition of allyloxsilanes" Organometallics, ACS, Washington, DC, US, vol. 7, No. 2, Jan. 1, 1988, pp. 528-531.

* cited by examiner

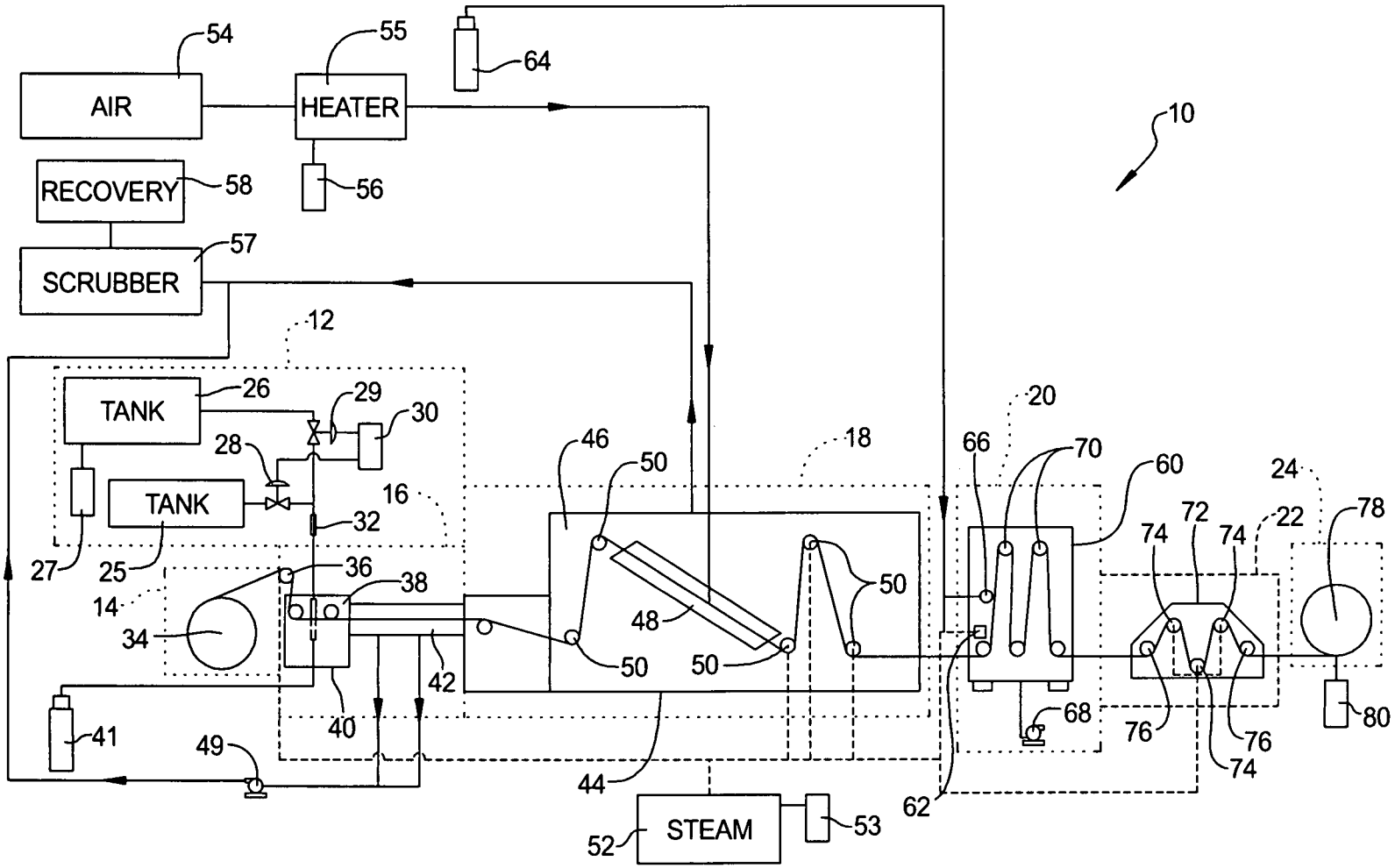
10
AIR
54
HEATER
55
56
64
RECOVERY
58
SCRUBBER
57
12
TANK
26
27
TANK
25
28
29
30
32
16
14
34
36
38
40
41
42
49
44
46
48
50
18
20
22
24
STEAM
52
53
60
62
66
68
70
72
74
76
78
80

APPARATUS AND METHOD FOR TREATING MATERIALS WITH COMPOSITIONS

CROSS-REFERENCE TO RELATED APPLICATION(S)

The present application is a divisional of U.S. Ser. No. 11/801,139, filed May 9, 2007.

BACKGROUND OF THE INVENTION

1. Field of the Invention

The present invention relates generally to treating materials and, more particularly, to an apparatus and method for treating materials with compositions.

2. Description of the Related Art

Certain materials are susceptible to damage caused by, for example, water, fire, and/or insects (e.g., termites, certain types of ants, and other boring insects). For instance, exposure to water typically causes many materials, such as various wood products, paper, cellulose material, insulation, newsprint, drywall, textiles, and masonry bricks, to crack, warp, check, or discolor. Exposure to water may also cause mold and mildew to grow on the material. Exposure to fire typically causes these materials to be singed, scorched, and/or charred, especially if the material itself ignites. In addition, water, fire, and/or insect damage often causes these materials to rot and decay. Typically, water, fire, and/or insect damage leads to the eventual replacement of the damaged section of the material at great expense, effort, and inconvenience.

There are various treatment products on the market that supposedly prevent or reduce the likelihood of water, mold, fire, and/or insect damage to the material to which the treatment products are applied. These products may be manually applied. However, these treatment products have not been completely satisfactory, especially with regard to effectiveness, cost concerns, ease of application, duration of treatment time, and duration of protection afforded.

Therefore, it is desirable to provide an apparatus for treating various materials with a composition. It is also desirable to provide a method for treating various materials with a composition. Further, it is desirable to provide a composition that treats various materials against water intrusion, insect intrusion, mold and mildew growth, and/or fire damage. In addition, it is desirable to provide a composition that treats various materials to stabilize the material such as paper. Still further it is desirable to provide an apparatus and method that treats paper with a composition and recovers a by-product from the treatment such as hydrochloric (HCL) acid. It is also desirable to provide an apparatus and method that treats paper with a composition and neutralizes acidity of the paper after treatment with the composition. Furthermore, it is desirable to provide an apparatus and method that treats paper with a composition and increases completeness of reaction. Therefore, there is a need in the art to provide an apparatus and method that meets at least one of these desires.

SUMMARY OF THE INVENTION

It is, therefore, one object of the present invention to provide a new apparatus and method for treating various materials with a composition.

It is another object of the present invention to provide a new apparatus and method for treating various materials with a composition such that the materials resist water, mold, mildew, fire, and/or insect damage.

To achieve the foregoing objects, the present invention is an apparatus for treating a subject material with a composition. The apparatus includes a material treatment section for treating a subject material with a composition comprising a silane-containing material and a hydrocarbon solvent to form a treated material. The apparatus also includes a neutralizing section for neutralizing the treated material such that the treated material has a pH in a range of approximately 7 to approximately 8.

Additionally, the present invention is a method for treating a subject material with a composition. The method includes the steps of providing an apparatus having a material treatment section and a neutralizing section. The method also includes the steps of treating a subject material in the material treatment section with a composition comprising a silane-containing material and a hydrocarbon solvent and forming a treated material. The method also includes the steps of neutralizing the treated material in the neutralizing section such that the treated material has a pH in a range of approximately 7 to approximately 8.

One advantage of the present invention is that an apparatus and method is provided for treating various materials with compositions. Another advantage of the present invention is that the compositions treat various materials effectively against water intrusion and damage, mold and mildew, insect intrusion, and/or fire damage. Yet another advantage of the present invention is that the apparatus and method treats various materials such as paper and recovers a by-product from the treatment such as HCL. An additional advantage of the present invention is that the apparatus and method treats various materials such as paper and neutralizes an acidity of the paper after treatment with the composition. Still another advantage of the present invention is that the apparatus and method treats various materials such as paper with a composition and increases completeness of reaction of the composition on the treated material. A further advantage of the present invention is that the apparatus and method treats various materials with compositions and is relatively inexpensive. Yet a further advantage of the present invention is that the apparatus and method treats various materials with compositions and are relatively easy to apply. Still a further advantage of the present invention is that the apparatus and method treats various materials with compositions and have a relatively short treatment time.

Other objects, features, and advantages of the present invention will be readily appreciated, as the same becomes better understood, after reading the subsequent description taken in conjunction with the accompanying drawings.

BRIEF DESCRIPTION OF THE DRAWINGS

FIG. 1 is a schematic view of an apparatus, according to the present invention, for treating various materials with compositions.

DESCRIPTION OF THE PREFERRED EMBODIMENT(S)

Referring to the drawings and in particular FIG. 1, one embodiment of an apparatus 10, according to the present invention, is shown for treating various subject materials with compositions, according to the present invention. The compositions of the present invention are used for treating subject materials to impart stability and/or protection against various sources of damage, including, but not limited to, water, mildew, mold, fire, and/or insects. The term "treating" as that term is used means treating subject materials for stabilization and/or for protection from damage caused by any source, including, but not limited to, water, mildew, mold, fire, and/or insects. The term "subject material" as used herein is meant to include any material or object that can be treated with the compositions of the present invention, including, but not limited to, wood products (i.e., products containing any amount of wood), cellulose material (e.g., textiles, cotton, cloth, etc.), paper (e.g., cardboard, roofing paper, paper used to coat insulation, sheet rock paper, newsprint, paper towel, etc.), insulation, drywall, rock, masonry (e.g., brick), and sugar. It should be appreciated that the compositions penetrate the subject materials.

In accordance with one embodiment of the present invention, the composition includes at least one silane-containing material and a carrier such as a hydrocarbon solvent. The silane-containing material prevents moisture intrusion for waterproofing. To prevent insect intrusion, the composition may include a boron-containing material. To prevent burning, the composition may include a fire-resistant material.

The boron-containing material is preferably in the form of boric anhydride (chemical formula: $B_2O_3$), although other forms of boron-containing materials are acceptable. By way of a non-limiting example, borax (chemical formula: $Na_2B_4O_7.10H_2O$), and disodium octaborate tetrahydrate (chemical formula: $Na_2B_8O_{13}.4H_2O$) may be used as well. Effective fungal and fire resistance can be obtained with a boron loading of 0.1 weight percent, based on the total weight of the treated material. However, in order to prevent wood-boring insect infestation (e.g., by ants and termites), a loading of 1-2 weight percent of boron is generally required. For more problematic insects, such as the Formosan termite, a loading of seven (7) weight percent of boron is generally required. Therefore, the present invention provides compositions to introduce boron into the material at levels of at least about 0.1 to at least about seven (7) weight percent and seal it to prevent environmental factors (e.g., rain) from leaching it from the interior of the treated material.

Silanes are generally defined as a class of silicon-based materials, analogous to alkanes, that is, straight-chain, saturated paraffin hydrocarbons having the general formula $Si_NH_{2N+2}$, wherein N is an integer equal to 1 or higher. The silane-containing material is preferably in the form of trichloromethylsilane (chemical formula: CH.sub.3Cl.sub.3Si), although other forms of silane-containing materials are acceptable. Examples of other silane-containing materials useful in practicing the present invention include, without limitation:

(Chloromethyl) Trichlorosilane;
[3-(Heptafluoroisoproxy)Propyl]Trichlorosilane;
1,6-Bis(Trichlorosilyl)Hexane;
3-Bromopropyltrichlorosilane;
Allylbromodimethylsilane;
Allyltrichlorosilane;
Bromomethylchlorodimethylsilane;
Bromothimethylsilane;
Chloro(Chloromethyl)Dimethylsilane;
Chlorodiisopropyloctylsilane;
Chlorodiisopropylsilane;
Chlorodimethylethylsilane;
Chlorodimethylphenylsilane;
Chlorodimethylsilane;
Chlorodiphenylmethylsilane;
Chlorotriethylsilane;
Chlorotrimethylsilane;
Dichlorodimethylsilane;
Dichloromethylsilane;
Dichloromethylvinylsilane;
Diphenyldichlorosilane;
Di-t-Butylchlorosilane;
Ethyltrichlorosilane;
Iodotrimethylsilane;
Pentyltrichlorosilane;
Phenyltrichlorosilane;
Trichloro(3,3,3-Trifluoropropyl)Silane;
Trichloro(Dichloromethyl)Silane; and
Trichlorovinylsilane.

The carrier is in the form of a hydrocarbon solvent, preferably a hydrocarbon alkane, although other hydrocarbon solvents are acceptable. For example, hydrocarbons, which are liquid at room temperature, are acceptable. Examples of these hydrocarbons include, without limitation, pentane, hexane, and heptane. In addition, for some applications, a lower carbon hydrocarbon may be used.

In one embodiment, the silane-containing material and hydrocarbon solvent are liquids with either different boiling points or boiling points in different ranges to form a liquid composition. The composition, being in a liquid form, is then applied to treat the materials. In another embodiment, the silane-containing material and hydrocarbon solvent have a boiling point that is either the same or in the same range. In this embodiment, the silane-containing material and hydrocarbon solvent are vaporized or put in a gaseous or vapor form. The composition, being in a vapor form, is then applied to treat the materials.

Referring to FIG. 1, one embodiment of the apparatus 10 includes a composition section 12, a feeding section 14, a material treatment section 16, a removal section 18, a neutralization section 20, a drying section 22, and a collecting section 24. In the composition section 12, the apparatus 10 includes at least one tank. The at least one tank either holds the composition to be applied to the subject material or holds one component of the composition. In the embodiment illustrated, the apparatus 10 includes a first tank 25 to hold one component of the composition such as a silane-containing material and a second tank 26 to hold another component of the composition such as a hydrocarbon solvent. In one embodiment, the silane-containing material is methyltrichlorosilane (MTS) and the hydrocarbon solvent is pentane. The apparatus 10 also includes a controller 27 such as a temperature controller electrically connected to the second tank 26 to control a temperature of the hydrocarbon solvent in the second tank 26. It should be appreciated that the composition is formed from at least the silane-containing material and hydrocarbon solvent. It should also be appreciated that the tank includes devices (not shown) such as heaters to change a temperature of the tank.

In the composition section 12, the apparatus 10 includes a flow control valve 28 fluidly connected to the first tank 25. The flow control valve 28 may be set to a predetermined flow such as 0-5 GPM. In the composition section 12, the apparatus 10 includes a flow control valve 29 fluidly connected to the second tank 26. The flow control valve 28 may be set to a predetermined flow such as 0-5 GPM. The apparatus 10 also includes a controller 30 such as a flow controller electrically connected to the flow control valve 28 and flow control valve 29 to set a desired percentage of the component. The apparatus 10 further includes a mixer 32 downstream of the flow control valve 28 to mix the hydrocarbon solvent and silane-containing material together to form the composition. The mixer 32 is of a static type. It should be appreciated that, once the composition is formed, the composition is then delivered to the material treatment section 16 of the apparatus 10.

In the feeding section 14, the apparatus 10 includes a feeder 34 for feeding the subject material to the material treatment section 16. In the embodiment illustrated, the subject material to be treated is paper and the feeder 34 is a backstand with a brake. The feed speed is controlled by a collector 62 such as a rewinder to be described. The apparatus 10 includes a heater 36 to heat the material to a predetermined temperature. In one embodiment, the heater 36 is at least one heated roller over which the paper is heated to a temperature near the boiling point of the hydrocarbon solvent. It should be appreciated that the heater 36 is connected to the controller 30 for controlling the heater 36.

In the material treatment section 16, the apparatus 10 includes at least one applicator 38 for applying the composition to the subject material. In one embodiment, the composition is of a liquid type and the applicator 38 is of a liquid type such as a dip tank that receives and contains the liquid composition that is applied to the subject material. In this embodiment, the heated subject material is passed through the dip tank with a constant level of the composition. The constant level is controlled by the speed of the subject material through the apparatus 10 and flow of the composition to the dip tank. In another embodiment using the liquid composition, the applicator 38 is a fluid slot-die that receives and applies the composition. The heated subject material is run over the slot-die and the saturation of the material is controlled by the slot width and the pressure of the composition. In another embodiment, the composition is in a gaseous or vapor form and the applicator 38 is of a vapor type to apply a vapor composition to the subject material. It should be appreciated that the subject material must be completely saturated with the composition. It should also be appreciated that the material treatment section 16 may include one or more rollers 39 for directing the subject material through the applicator 38. It should also be appreciated that the dip tank and slot-die are conventional and commercially available.

In the material treatment section 16, the apparatus 10 includes a treatment chamber 40. The treatment chamber 40 is formed by a housing. The treatment chamber 40 must be kept in a dry atmosphere. In one embodiment, the treatment chamber 40 is kept dry by using a dry inert gas such as Nitrogen and/or dry air. In the embodiment illustrated, the treatment chamber 40 is connected to a source 41 such as Nitrogen. For this example, the Nitrogen has a flow of 3 SCFH. The apparatus 10 also includes a vacuum chamber 42 downstream of the treatment chamber 40. The vacuum chamber 42 is formed by a housing. In the vacuum chamber 42, the treated material passes through to ensure that the composition has penetrated the subject material and to remove excess components and/or byproducts of the composition such as hydrocarbon solvent vapor and/or hydrochloric acid (HCL) vapor, respectively. The HCL vapor is evacuated by a blower 49 to an HCL scrubber 50 to be described. It should be appreciated that, after the subject material has been saturated, the treated material is fed across the vacuum chamber 42 to make sure the composition has fully penetrated the subject material and to help in the removal of hydrocarbon solvent and hydrochloric (HCL) acid.

In the removal section 18, the hydrocarbon solvent must be flashed off the treated material and moisture reduced in the treated material. The apparatus 10 includes at least one drying chamber 44. In the drying chamber 44, the temperature of the treated material is raised above the boiling point of the hydrocarbon solvent. The drying chamber 44 is formed by a housing and includes a dryer section 46 and an oven section 48. In one embodiment, the apparatus 10 includes at least one steam roll, preferably a plurality of steam rolls 50, in the dryer section 46. The steam rolls 50 are connected by piping to a source 52 of saturated steam. In one embodiment, the source 52 is a steam generator such as a steam boiler and is controlled by a controller 53 such as a steam pressure controller. It should be appreciated that the steam rolls 50 are connected to a source of saturated steam or hot water to produce the heat required for the steam rolls 50.

In the drying chamber 44, the dryer section 46 must have an inert atmosphere. This is accomplished by using a combination of an inert gas such as Nitrogen during start-up and shut-down and by maintaining a vapor level of the hydrocarbon solvent above an upper explosive limit (UEL) during operation. In the oven section 48, the heated dry air reduces moisture in the treated material. The oven section 48 is connected by piping to a source 54 of hot dry air and an air heater 55 for heating the hot dry air. In one embodiment, the air heater 55 is controlled by a controller 56 such as an air temperature controller. It should be appreciated that the drying chamber 44 may include one or more rolls 50 for directing the treated material through the removal section 18.

In the removal section 18, HCL vapor is formed as a byproduct of the reaction. The excess hydrocarbon solvent and/or HCL are removed by maintaining a slight negative pressure in the drying chamber 44 and/or vacuum chamber 42. The removed hydrocarbon solvent and HCL are fed through piping to a HCL scrubber 57 to remove the HCL from the vapor stream. The HCL is recovered from the HCL scrubber 57 and concentrated for subsequent transfer. The hydrocarbon solvent is fed through a solvent recovery system 58 to remove the hydrocarbon solvent from the vapor stream. The hydrocarbon solvent is recovered from a solvent recovery system 58 and is used to make the composition.

In the neutralization section 20, the treated material is free of the hydrocarbon solvent, but may contain some HCL in liquid form and/or chlorides trapped in the treated material along with some unreacted silane-containing material. In one embodiment, the apparatus 10 includes a neutralization chamber 60. The neutralization chamber 60 is formed by a housing and connected to the source 52 of heated dry air. In the neutralization chamber 60, the treated material is further treated in at least one, preferably a plurality of stages. In the first stage, the treated material is hydrated with steam from the source 52 to remove any latent silane-containing material and to heat the treated material to drive the reaction to completion. In the apparatus 10, the steam is applied to the treated material by an applicator 62. In the second stage, the treated material is neutralized. In the embodiment illustrated, the treated material is neutralized with a base-containing material from a source 64. Preferably, the base-containing material is a caustic liquid or gas (strength dependent on the HCL/chlorides remaining in the material). In the apparatus 10, the base-containing material is applied to the treated material through direct contact by an applicator 66 or delivered in the steam flow from the applicator 62. In one embodiment, the base-containing material is an ammonia ($NH_3$) added to the steam to deliver an ammoniated steam to the treated material in the neutralizing chamber 60. The excess base-containing vapor is evacuated by a blower 68 to atmosphere. It should be appreciated that the neutralization section 20 may include one or more rollers 70 for directing the subject material through the neutralizing chamber 60. It should also be appreciated that, in addition to hydrating the treated material and reacting the steam with any latent silane-containing material in the treated material, the steam will raise the temperature of the treated material and increase the rate of reaction completion. It should be appreciated that the base-containing material will neutralize any latent HCL in the treated material and bring the pH level of the treated material between approximately 7-8. It should further be appreciated that the treated material will then enter the drying section 22 of the apparatus 10 and the moisture will be reduced to a customer's specifications. It should still further be appreciated that, after the drying section 22, the treated material is collected in the collecting section 24, tested, and prepared for shipment to the customer.

In the drying section 22, the apparatus 10 includes a drying chamber 72 formed by a housing. In one embodiment, the apparatus 10 includes at least one steam roll, preferably a plurality of steam rolls 74, in the drying chamber 72. The steam rolls 74 are connected by piping to the source 52 of saturated steam. It should be appreciated that the steam rolls 74 are connected to a source of saturated steam or hot water to produce the heat required for the steam rolls 74. It should also be appreciated that the drying section 22 may include one or more rollers 76 for directing the subject material through the drying chamber 72.

In the collecting section 24, the apparatus 10 includes a collector 78 to collect the treated material. In one embodiment, the collector 78 is a rewinder. The collector 78 is connected to a controller 80 such as a feed rate controller for controlling the feed rate. It should be appreciated that the treated material is removed from the collector 78 and tested, and prepared for shipment to the customer.

The apparatus 10 and processing conditions for the apparatus 10 are controlled via the controllers 27, 30, 53, 56, and 80. In one embodiment, the subject material is paper. The process conditions and ranges are as follows:

| Process Settings | |
|---|---|
| Material Speed | 10-200 feet per minute |
| Composition Flow | 1-4 gallons per minute |
| Steam Pressure | 20-150 PSIG |
| Pump Speed | 0-60 Hz |
| Composition Pressure | 0-60 PSIG |
| Scrubber Blower Set Point | 0-60 Hz |
| Heat Chamber Vacuum | 0-2 In W.C. |
| Hot Air Temperature SP/PV | 100-300/100-300 |
| Hot Air Blower Set Point | 0-60 Hz |
| Saturation Vacuum Chamber SP | 0-2 In W.C. |
| Apparatus Temperature | 100-250 Deg. F. |
| Composition Temperature TK/PM | 0-110/0-110 Deg. F. |
| Hydration Steam PSI | 0-150 PSIG |
| Hydration Air PSI | 0-50 PSIG |
| Hydration/Neut Vacuum | 0-30 SCFH |
| Vacuum (final) | 0-30 In W.C. |
| Temp Final Vacuum Chamber | 100-250 Deg. F. |
| Paper Moisture (initial) | 0-12% |
| Paper Moisture (final) | 0-10% |

In operation, the hydrocarbon solvent is loaded into the second tank 26 and heated by a heater (not shown) to a predetermined temperature just below the boiling point of the solvent. The pressure of the hydrocarbon solvent in the second tank 26 is set to a predetermined pressure. In one embodiment, the hydrocarbon solvent is pentane and the pentane is loaded into the second tank 26 and heated 5-10 degrees F. below the boiling point (temperature at atmospheric pressure). The pentane pressure in the second tank 26 is set at 15-40 PSIG. The flow control valve 29 is set to 0-5 GPM (dependent on subject material). The controller 30 is set to a desired silane-containing material such as (MTS) percentage (0.1-30% by volume) required by the subject material. The MTS flow is controlled by the controller 30 and the control valve 28 and blended into the pentane stream and goes through the static mixer 32 to form the composition. The composition is then delivered to the applicator 38 in the material treatment section 16 of the apparatus 10.

The subject material is loaded onto the feeder 34. In the embodiment illustrated, the subject material is paper and a roll of paper is loaded onto the feeder 34 and fed through the apparatus 10 to the collector 78. The controller 80 is connected to the collector 78 and the feeder 34 feeds the paper through the applicator 38 at a desired rate of speed. The applicator 38 applies the composition to the paper as the paper travels through the material treatment section 16 to the removal section 18. Excess pentane and a byproduct of reaction HCL in the material treatment section 16 flows to the HCL scrubber 57 and solvent recovery system 58 to be recovered.

The treated paper travels to the removal section 18. In the removal section 18, heated dry air from the source 54 is used to heat the drying section and hot water or steam is applied from the source 52 to the steam rolls 50 to produce heat that is passed through the paper. When this occurs, excess pentane and the byproduct HCL in the removal section 18 flow to the HCL scrubber 57 and solvent recovery system 58, respectively, to be recovered. The paper travels to the neutralization section 20.

In the neutralization section 20, the paper is heated again with direct steam. The steam may also include a neutralizing agent (base/caustic liquid or gas). Heated dry air from the source 52, water, and ammonia are applied to the neutralizing chamber 60 to produce steam that is passed through the paper to neutralize or reduce the acidity of the paper and restore the pH level to between approximately 7 and 8. In addition to hydrating the paper and reacting the steam with any latent silane-containing material in the treated material, the steam will raise the temperature of the paper and increase the rate of reaction completion. It should be appreciated that the steam will raise the temperature of the paper and increase the rate of reaction as well as hydrate the paper, thus reacting any latent silane-containing material in the treated paper. It should also be appreciated that the neutralizing agent may also be applied separate of the steam in the neutralization section 20. It should further be appreciated that the paper is neutralized to restore its pH level to between approximately 7 and approximately 8.

In the drying section 22, the paper is heated again. Heated dry air from the source 52 and water are applied to produce steam that is passed through the paper. The paper is then collected on the collector 78 in a roll. It should be appreciated that the drying chamber 72 of the apparatus 10 will reduce the moisture in the treated material to a customer's specifications. It should also be appreciated that, after the drying chamber 72, the treated material is collected on the collector 78 of the collecting section 24, tested, and prepared for shipment to the customer. It should further be appreciated that the process parameters (e.g., speed, flow rate, etc.) will increase as the process is scaled up to production levels.

In another embodiment, the silane-containing material in the first tank 25 and the hydrocarbon solvent in the second tank 26 have a boiling point that is either the same or in the same range. In this embodiment, the silane-containing material and hydrocarbon solvent are vaporized or put in gaseous or vapor form by heaters (not shown) for the tanks 25 and 26. The composition, being in a vapor form, is then applied by the applicator 38 to treat the materials. It should be appreciated that the vapor form of the composition is used to effectively penetrate the material such as paper, cloth, etc. as opposed to the liquid form of the composition.

The present invention has been described in an illustrative manner. It is to be understood that the terminology, which has been used, is intended to be in the nature of words of description rather than of limitation.

Many modifications and variations of the present invention are possible in light of the above teachings. Therefore, the present invention may be practiced other than as specifically described.

What is claimed is:

1. A method for treating subject materials with compositions, said method comprising the steps of:

providing an apparatus having a material treatment section and a neutralizing section different from the material treatment section;

treating a subject material in the material treatment section with a composition comprising a silane-containing material and a hydrocarbon solvent and forming a treated material, wherein HCI is present in the treated material as a by-product of treatment;

exposing the subject material to steam, the steam optionally including a neutralizing agent; and wherein the steam is passed through at least a portion of the subject material to cause hydration of the subject material, heating of the subject material, and reaction of any latent silane-containing material; and wherein the neutralizing agent can neutralize the HCI in the treated material in the neutralizing section such that the treated material has a pH in a range of approximately 7 to approximately 8.

2. A method as set forth in claim 1 including the step of removing at least one of moisture, hydrocarbon solvent, or byproduct of reaction from the treated material in a removal section of the apparatus.

3. A method as set forth in claim 1 including the step of providing a feeding section for the apparatus and feeding the subject material to the material treatment section.

4. A method as set forth in claim 3 wherein said feeding section comprises a feeder to feed a roll of the subject material to the material treatment section.

5. A method as set forth in claim 1 including the step of providing a collecting section for the apparatus and collecting the treated material.

6. A method as set forth in claim 5 including the step of collecting the treated material with a collector in the collecting section.

7. A method as set forth in claim 1 including the step of providing a drying section for the apparatus and drying the treated material.

8. A method as set forth in claim 1 including the step of providing a composition section for the apparatus and forming the composition.

9. A method as set forth in claim 1 including the step of applying the composition to the subject material with an applicator in the material treatment section.

10. A method as set forth in claim 9 wherein said step of applying comprises applying a liquid composition to the subject material with a liquid applicator.

11. A method as set forth in claim 9 wherein said step of applying comprises applying a vapor composition to the subject material with a vapor applicator.

12. A method as set forth in claim 1 wherein the neutralizing agent comprises an added base.

13. A method as set forth in claim 12 wherein the added base comprises ammonia.

14. A method as set forth in claim 1 including the step of removing excess hydrocarbon solvent for the treated material in a removal section of the apparatus.

15. A method as set forth in claim 1 including the step of removing a byproduct of reaction for the treated material in a removal section of the apparatus.

16. A method as set forth in claim 1 including the step of drying the treated material.

17. A method as set forth in claim 1 including the step of forming the composition.

18. A method for treating subject materials with compositions, said method comprising the steps of:

providing an apparatus having a material treatment section and a neutralizing section different from the material treatment section;

feeding a subject material to the material treatment section;

treating the subject material in the material treatment section with a composition comprising a silane-containing material and a solvent and forming a treated material, wherein HCI is present in the treated material as a by-product of treatment;

exposing the subject material to steam that includes an added base; and wherein the steam is passed through at least a portion of the subject material to cause hydration of the subject material, heating of the subject material, and reaction of any latent silane-containing material; and wherein the added base can neutralize the HCI in the treated material in the neutralizing section such that the treated material has a pH in a range of approximately 7 to approximately 8; and collecting the treated material.

19. A method as set forth in claim 18 including the step of removing moisture, hydrocarbon solvent, or byproduct of reaction from the treated material.

* * * * *